United States Patent [19]

Oliver et al.

[11] Patent Number: 4,505,085

[45] Date of Patent: Mar. 19, 1985

[54] SPLIT PANEL ASSEMBLY

[76] Inventors: Wayne H. Oliver; Janet L. Oliver, both of 1305 Spring Valley Rd. North, Minneapolis, Minn. 55422

[21] Appl. No.: 446,682

[22] Filed: Dec. 3, 1982

[51] Int. Cl.[3] ..... E04C 1/10

[52] U.S. Cl. ..... 52/582; 52/588; 52/803

[58] Field of Search ..... 52/802, 803, 804, 805, 52/588, 222, 223, 309.11, 810, 807, 582

[56] References Cited

U.S. PATENT DOCUMENTS

| | | | |
|---|---|---|---|
| 695,677 | 3/1902 | Faris . | |
| 864,801 | 9/1907 | Richards . | |
| 1,015,212 | 1/1912 | Schaffert . | |
| 1,281,599 | 10/1918 | Levaur . | |
| 1,418,257 | 5/1922 | Hay . | |
| 1,595,673 | 8/1926 | Magney et al. . | |
| 1,648,591 | 11/1927 | Repay . | |
| 1,655,662 | 1/1928 | Repay . | |
| 1,768,742 | 7/1930 | Brogden . | |
| 1,797,706 | 3/1931 | Winslow . | |
| 1,876,596 | 9/1932 | Belding | 52/803 |
| 1,882,678 | 10/1932 | Thum . | |
| 1,883,214 | 10/1932 | Wilson et al. . | |
| 2,086,571 | 7/1937 | Novambere . | |
| 2,345,694 | 4/1944 | Wilson . | |
| 2,347,090 | 4/1944 | Drake | 52/223 |
| 2,458,074 | 1/1949 | Hill . | |
| 2,497,657 | 2/1950 | Cole . | |
| 2,509,732 | 5/1950 | Ernestus . | |
| 2,611,460 | 9/1952 | Nash . | |
| 2,717,664 | 9/1955 | Grafman | 52/588 |
| 2,832,100 | 4/1958 | Swallert . | |
| 2,912,725 | 11/1959 | Ries | 52/803 |
| 2,914,147 | 11/1959 | Millard . | |
| 3,001,613 | 9/1961 | McBerty | 52/405 |
| 3,051,277 | 8/1962 | Day, Jr. . | |
| 3,066,436 | 12/1962 | Schuh . | |
| 3,070,186 | 12/1962 | Meek . | |
| 3,070,646 | 12/1962 | Lindgren . | |
| 3,074,522 | 1/1963 | Swick | 52/803 |
| 3,100,556 | 8/1963 | De Ridder | 52/588 |
| 3,133,326 | 5/1964 | Budny . | |
| 3,239,986 | 3/1966 | Russell . | |
| 3,267,626 | 8/1966 | Daly | 52/805 |
| 3,279,140 | 10/1966 | Oliver . | |
| 3,289,375 | 12/1966 | Cline . | |
| 3,301,149 | 1/1967 | Box . | |
| 3,327,870 | 6/67 | Fairchild, Jr, . | |
| 3,756,631 | 4/68 | Oliver . | |
| 3,386,220 | 6/1968 | Staats . | |
| 3,521,420 | 7/1970 | Oliver . | |
| 3,552,079 | 1/1971 | Mortensen . | |
| 3,559,356 | 2/1971 | Koral . | |
| 3,662,507 | 5/1972 | Espeland . | |
| 3,742,672 | 7/1973 | Schaeufele . | |
| 3,820,294 | 6/1974 | Parker . | |
| 3,919,819 | 11/1975 | Oliver | 52/233 |
| 3,994,105 | 11/1976 | Jamison et al. . | |
| 3,998,024 | 12/1976 | Frandsen | 52/802 |
| 4,008,553 | 2/1977 | Oliver . | |
| 4,021,973 | 5/1977 | Hegg et al. . | |
| 4,045,931 | 9/1977 | Becker | 52/791 |
| 4,141,183 | 2/1979 | Becker . | |
| 4,147,001 | 4/1979 | Oliver . | |
| 4,154,042 | 5/1979 | Epes | 52/309.11 |
| 4,186,539 | 2/1980 | Harmon et al. . | |
| 4,267,679 | 5/1981 | Thompson | 52/805 |

FOREIGN PATENT DOCUMENTS

| | | | |
|---|---|---|---|
| 477844 | 2/1979 | Switzerland . | |
| 628259 | 10/1978 | U.S.S.R. | 52/802 |

*Primary Examiner*—Henry E. Raduazo

*Attorney, Agent, or Firm*—Merchant, Gould, Smith, Edell, Welter & Schmidt

[57] ABSTRACT

An interlocking, load-bearing panel assembly which prevents thermal energy from being transferred thereacross is disclosed. Each panel assembly (15) includes a first load-bearing panel (20) and an identically constructed second load-bearing panel (20'). The panels are inverted with respect to each other and secured together at respective top and bottom portions with thermal insulating spacers (30, 30') inserted therebetween. A thermally insulating void space (32) is created between the secured panels (20, 20'). To interlock the panel assembly (15) with like panel assemblies in the construction of a building, vertical, load-bearing, split-member connectors (35, 35') are secured at opposite ends of the assembly (15). Each connector (35, 35') has two slotted members (31, 36) and a thermal insulating spacer (48) positioned therebetween to prevent transfer of thermal energy across the connector members. Panel assemblies of the present invention may be interlocked in end-to-end relationship or superimposed upon each other to create a thermally insulated building able to bear significant loads.

4 Claims, 10 Drawing Figures

SPLIT PANEL ASSEMBLY

TECHNICAL FIELD

The present invention relates to load-bearing building panels for construction purposes and in particular to an interlocking panel assembly which completely insulates the structure by preventing the transfer of thermal energy through the panel assembly.

BACKGROUND

Our co-pending patent application filed Dec. 7, 1981, U.S. Ser. No. 327,882, for a "Building Panel Construction", discloses an economical, yet high quality, insulated, interlocking load-bearing building panel construction requiring minimal effort in order to construct a building. The present invention is an improvement in the general concept of our earlier invention in that it provides an even more economically manufactured self-insulated, load-bearing panel assembly which interlocks with panel assemblies of like construction in the building of a structure. While the panel construction of our earlier invention was relatively simple in its design and arrangement, the present invention advances the art further without forfeiting the strength and insulating features so desirable in any panel assembly used to construct a building.

The present invention surpasses known prior art prefabricated building components in strength as well as being aesthetically pleasing. The panel assembly of the present invention is relatively light weight, despite its load-bearing capacity, thus allowing the assembly to be easily handled by two people without necessitating the assistance of additional mechanical equipment in most instances. A building composed of the panel assemblies of the present invention yields a structure which is virtually completely insulated in that each panel assembly functions independently to prevent differentials in thermal energy from being transferred across it or between adjacent panel assemblies. With rising energy costs, this is a critical factor of increasing significance to today's homebuilder.

Yet despite all its advantageous features, the present invention is amazingly economical in that its manufacturing demands are minimal in contrast to prior art panels. Reduced manufacturing requirements, structural integrity, thermal insulation and a design which allows unskilled people to erect the structure, are the advantages the present invention brings to a market regrettably lacking in viable prefabricated-type building components. It is believed the present invention advances the state of the art for building, and for homebuilding in particular, in an unobvious manner with a design of simplicity and strength which simultaneously provides a thermally insulated structure.

SUMMARY

The present invention is a load-bearing building panel assembly which is constructed and arranged to be interlocked with panel assemblies of like construction to yield an aesthetically pleasing, thermally insulated structure which is easily constructed and provides considerable load bearing capacity. Each panel assembly includes a pair of identically constructed panels. Each panel is inverted with respect to the other and fixed to the other along top and bottom portions to define an insulating void space therebetween. The secured or mating portions of the panels have thermal insulating spacers inserted therebetween to prevent transfer of thermal energy between the joined panels.

To interlock the panel assembly to a like panel assembly in the construction of a building, vertical load-bearing connectors are fixed at opposite ends of the assembly. Each connector is split in that it includes two separate slotted members of identical construction. One member is secured to one panel of the assembly with the other member being secured opposite thereto on the other panel of the assembly. A thermal insulating spacer is inserted between the portions of the slotted members which are secured together in order to prevent any transfer of thermal energy across the connector.

The void space existing between the panel pair and the end connectors may be filled with insulating material. The panel assemblies are interlocked one on top of the other and in end-to-end relationship in the construction of a building. Each panel assembly is capable of transferring lateral loads to the vertical end connectors where the load is transferred downwardly to the foundation of the structure.

DETAILED DESCRIPTION OF A PREFERRED EMBODIMENT OF THE PRESENT INVENTION

Figures 1, 2:
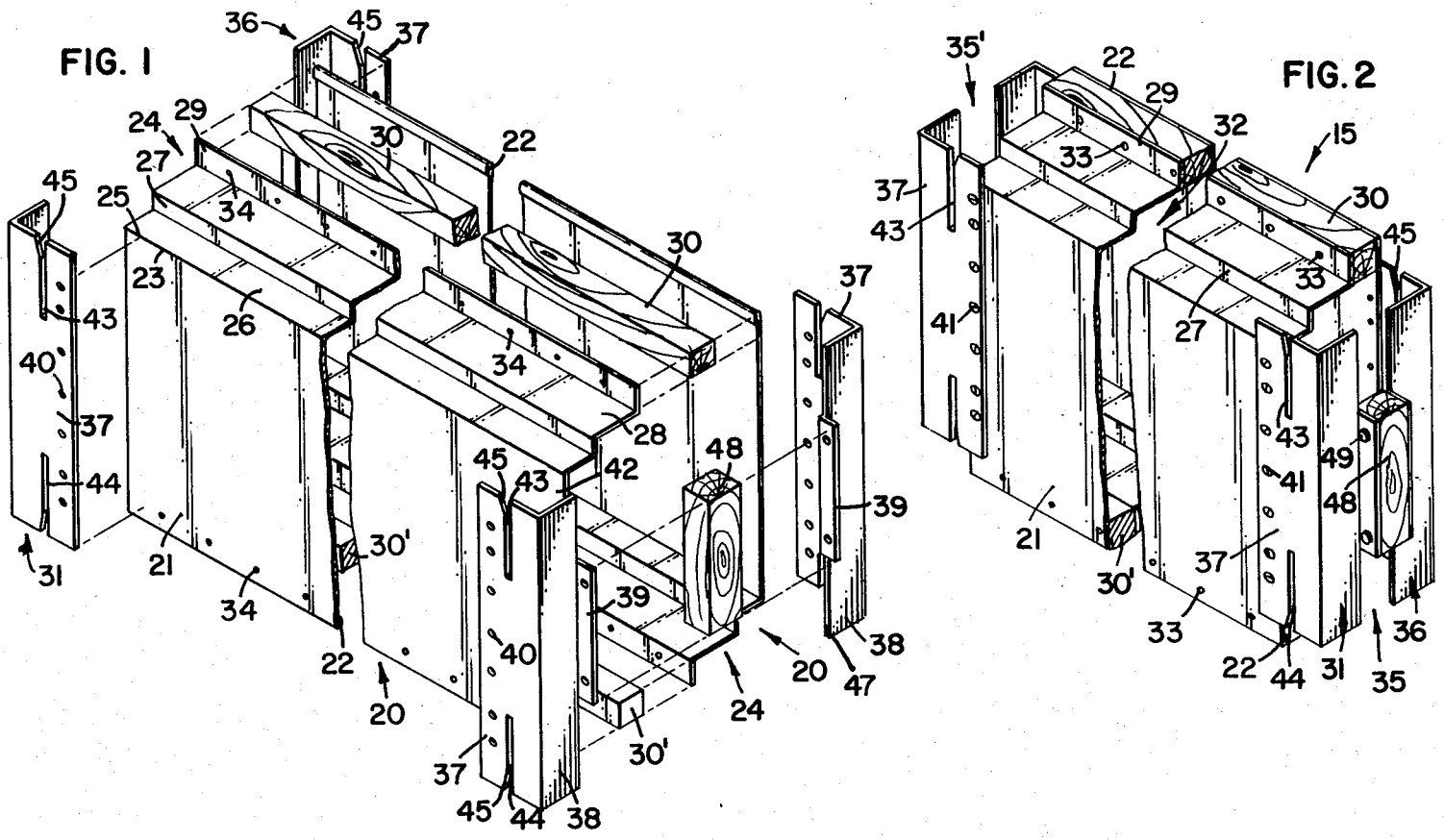
FIG. 1 is an exploded perspective view of a preferred embodiment of the present invention.
FIG. 2 is a perspective view of the preferred embodiment of the present invention.
Figure 3:
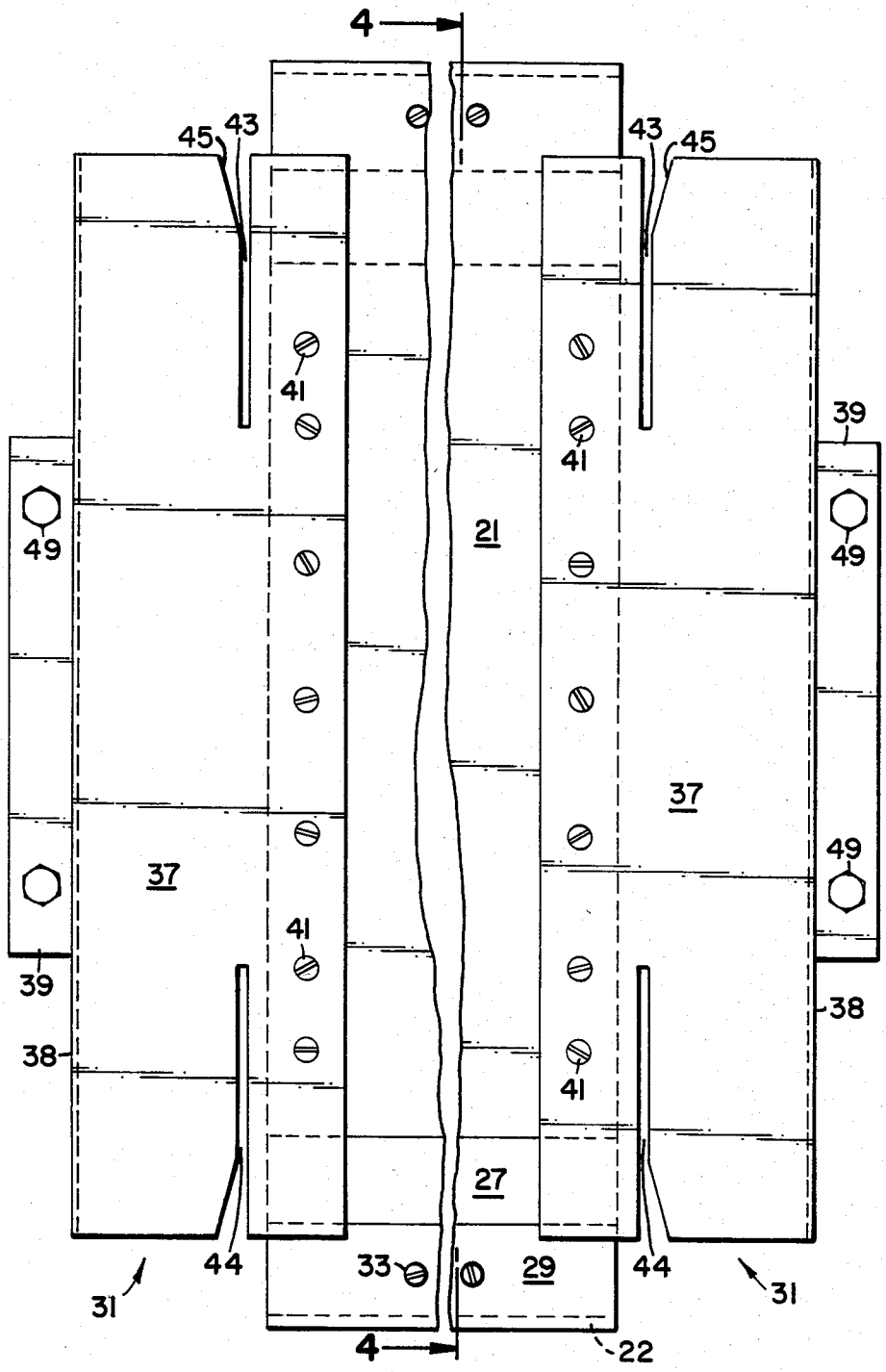
FIG. 3 is a side elevational view of the preferred embodiment of the present invention.

Referring particularly to FIGS. 1–5, the construction of the panel assembly 15 of the present invention may be understood. Each panel assembly 15 may be interlocked with a panel assembly of like construction located either above or below or at either end of the first panel assembly. This aspect of the invention will be explained in detail hereinafter. Each assembly includes a pair of substantially identically constructed panels 20, 20' secured together in a manner defining a top, a bottom and two opposing sides of the assembly with a thermally insulating void space defined therebetween. Each panel in the pair is inverted in its orientation with respect to the orientation of the other panel.

Preferably, the panels are constructed from sheet metal, e.g. 10 or 20 gauge. However, plywood could also be used. If constructed from sheet metal, a one-piece construction for each panel is achieved through use of conventional "press-break" methods for bending the sheet metal. Each panel 20,20' has a primary face portion 21 providing a smooth surface and one side of the panel assembly. Generally the primary face portion 21 will be rectangular in shape, with its length being greater than its height. A first free end or edge 22 of the face portion 21 may be rolled back to form a smooth finished surface. The opposite end 23 of the face portion 21 is formed integral with a first end 25 of the connecting portion 24 of the respective panel 20, 20'.

The connecting portion 24 of each panel 20,20' extends from the second end 23 of the primary face portion 21 at substantially right angles thereto. To provide strength to the connecting portion 24, as well as to provide a unique insulating feature to be further explained hereinafter, the connecting portion 24 is pressed or formed into a two-step configuration. The first step or extension 26 extends a pre-determined distance, generally at a right angle, from the second end 23 of the primary face portion 21. This step or extension 26 is terminated by the formation of a connecting wall 27 bent so as to extend upwardly from the first extension 26 a pre-determined distance in a plane substantially parallel to the plane of the primary face portion 21. At the pre-determined distance, the upright connecting wall 27 is bent and a second step or extension 28 is formed which extends in a direction away from the primary face portion 21, but in a plane substantially parallel to the first step or extension 26, and hence substantially normal to the primary face portion 21. The second step or extension 28 extends a pre-determined distance and then is bent to continue upwardly a pre-determined distance to form a connecting flange portion or free end 29. This free end 29 lies in a plane substantially parallel to that of the primary face portion 21.

This first described panel provides a top and a side of the panel assembly. A second panel 20' of substantially identical construction provides a bottom and an opposite side of the panel assembly. To complete the panel assembly the second panel 20' is inverted relative to the first panel 20. See FIGS. 1 and 4. Inverting one of the panels orients both panels such that the connecting flange portion 29 of the first panel 20 is located in mating relationship with the free end 22 of the primary face portion 21 of the second panel 20', and the free end 22 of a primary face portion 21 of the first panel 20 is situated opposite the connecting flange portion 29 of the second panel 20'. Before securing these portions of the two panels together a thermal insulating spacer 30, 30' is inserted between the two panels such that any direct contact between the two panels is prevented despite their securement together. See FIGS. 2 and 4.

The thermal insulating spacers 30, 30' prevent the transfer of thermal energy from one side of the panel assembly to the other side by preventing such transfer through the panel itself. The void or dead space 32 created between the two panels 20, 20' provides an additional insulating feature of the assembly. The spacers 30, 30' may be made from any material which is a non-conductor of thermal energy, e.g. wood, plastic, etc. In the drawings of the preferred embodiment, the spacers are indicated as being made from wood, i.e. redwood.

To secure the panel portions together with a respective spacer therebetween, a plurality of fasteners 33 are provided at spaced intervals along the length of the connecting flange portion 29 of each panel 20, 20' and the corresponding portion of the primary face portion 21 to which it is mated. Preferably, the fasteners 33 are blind bolts which are self-threading thereby eliminating the need for insuring critical alignment of holes in the three elements, i.e. the panel flange portions 29, the respective spacers 30, 30' and the panel face portions 21. Thus, in the preferred embodiment holes or apertures 34 are provided along the length of each panel's connecting flange portion 29 and the corresponding end portions of the other panel but are not provided in the spacers 30, 30'.

In order to use the panel assembly to construct a building, a number of panel assemblies 15 must be connected together and interlocked relative to each other. To form connecting ends of the otherwise "open" panel assembly, a pair of vertical, load-bearing end connectors 35, 35' are used. One connector is situated at each "open" end of the secured panel pair. Each connector 35, 35' is a split connector in that two separate members 31, 36 form the connector. As can be seen in FIGS. 1 and 2, each end connector 35, 35' has a first slotted member 31 and a second slotted member 36 which is constructed identical to the first member 31. Each member has a slotted leg or flange 37, a solid leg or flange 38 extending substantially at a right angle to the slotted leg 37, and a shorter connecting flange 39 extending substantially at a right angle to the solid leg 38 in a plane generally parallel to that of the slotted leg 37.

The slotted leg 37 includes a plurality of apertures 40 through which fasteners 41 are inserted for securing the member to an end portion 42 of a respective panel primary face portion 21. This securement is accomplished with rivets or another suitable conventional fastener. Spaced apart from the apertures 40 on the leg 37 and extending inwardly towards each other from top and bottom edges of the leg 37 are a pair of slots, i.e. an upper slot 43 and a lower slot 44. Each slot 43, 44 extends approximately one-fourth the height of the connector. The open edge of each slot 43, 44 includes a cut-away portion 45 defining a notched area which allows the member to be more easily inserted into a slot of another connector, i.e. either a like connector on a second panel assembly or a second type of connector to be discussed hereinafter. The slotted leg 37 lies in a plane parallel to the respective panel face portion 21 for flush securement thereto.

Extending from the slotted leg 37 at substantially right angles is a solid leg 38. This leg 38 is generally the same height as the slotted leg 37. To secure the first member 31 to the second member 36 of the respective split connector a connecting flange 39 is provided each member. Each flange 39 extends from a central portion of the free edge 47 of the respective solid leg 38 at a substantially right angle thereto in a plane substantially parallel to that of the slotted leg 37. The connecting flange 39 is approximately one half the height of the solid leg 38 and situated centrally along the height of the solid leg 38. This positioning is selected in order to prevent any obstruction of one connector with another when the corresponding members of two connectors are interlocked together. The slotted legs of the interlocked connectors are allowed to fit together without interference from the connecting flange.

To complete the panel assembly for purposes of interlocking it with another assembly the two members 31, 36 of each connector 35, 35' are secured on respective panel primary face portions 21 directly opposite each other with the connecting flanges 39 positioned adjacent each other for securement together. See FIGS. 1 and 2. Prior to securing the connecting flanges together a second thermal insulating spacer 48 is inserted therebetween. The provision of a thermal insulating spacer 48 between the mating flange portions 39 of the connector members prevents the transfer of thermal energy from one member to the other. In this manner, the panel assembly is further insulated.

The fasteners 41 used to secure each member's slotted leg 37 to a respective face portion 21 may be rivets or countersunk screws. The fasteners 49 used to secure the connecting flanges and thermal spacer together are preferably bolts with locking nuts.

At this point in the discussion, it should be noted that the completed panel assembly is composed of two identical halves each inverted relative to the other with the entire assembly being a load-bearing unit. Loads may be transferred laterally by the panels 20, 20' to the vertical end connectors 35, 35'. The vertical end connectors 35, 35' then transfer the load downwardly through other load-bearing connectors to the foundation of the structure. Each panel assembly 15 of a structure is fully insulated and thus differentials in thermal energy which may exist on one side of the assembly are not transferred across the assembly to the other side.

Referring specifically to FIGS. 1 and 2, the manner in which the assembly is constructed may be summarized. Each assembly includes two identical panels 20, 20' inverted in their orientation with each other, two spacers 30, 30' for the two areas, i.e. top and bottom areas of the assembly, where the panels are secured to each other and a pair of split connectors 35, 35' each at either "open" end of the secured panels. Each connector 35, 35' includes identical member halves connected together but thermally insulated from the other by spacers 48 inserted between connecting portions 39 of the members. Essentially, the assembly 15 has three elements, i.e. a panel, a connector half member, and a spacer. The design basis of this invention is remarkably simple yet it provides a combination of advantages unobvious from the known prior art.

To fully appreciate the role the present invention can play in the future of the construction industry and particularly the homebuilding segment of the industry, a residential building constructed from panel assemblies of the present invention will be described. Reference is now made to FIGS. 6–10 of the drawings.

Figure 6:
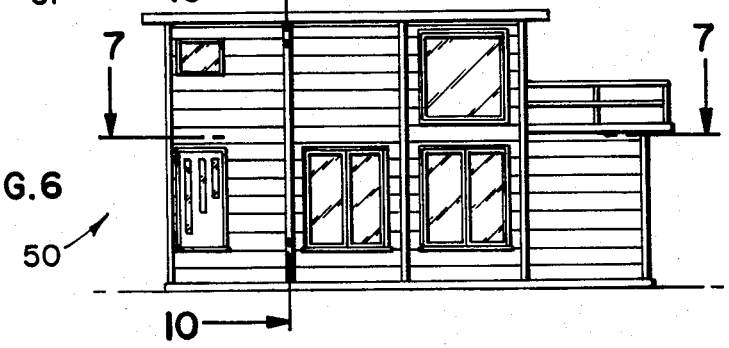
FIG. 6 is a side elevational view of a building constructed from a plurality of panel assemblies of the present invention.
Figure 7:
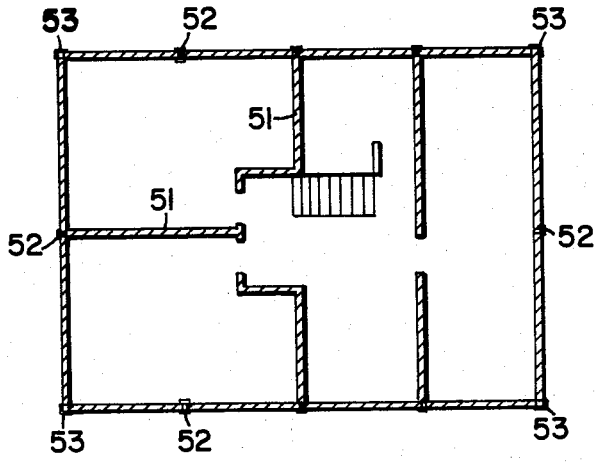
FIG. 7 is a cross-sectional view of the building as generally seen along lines 7—7 in FIG. 6.

In FIG. 6, one side of a residential or single-family structure 50 is shown as it would appear when constructed from a number of panel assemblies 15 of the present invention which have been interlocked together. The structure 50 is two story and the usual doors and windows are placed in selected locations with the panel assemblies being modified accordingly to accommodate the window or door therein. An interior plan view or cross-sectional view of the structure is illustrated in FIG. 7. From FIG. 7, it can be appreciated that interior walls 51 may be constructed inwardly from the vertical juncture 52 of two vertical segments of exterior wall panel assemblies. Furthermore, the corners 53 of the building 50 are securely constructed by the interlocking of panel assemblies one on top of the other.

Figure 8:
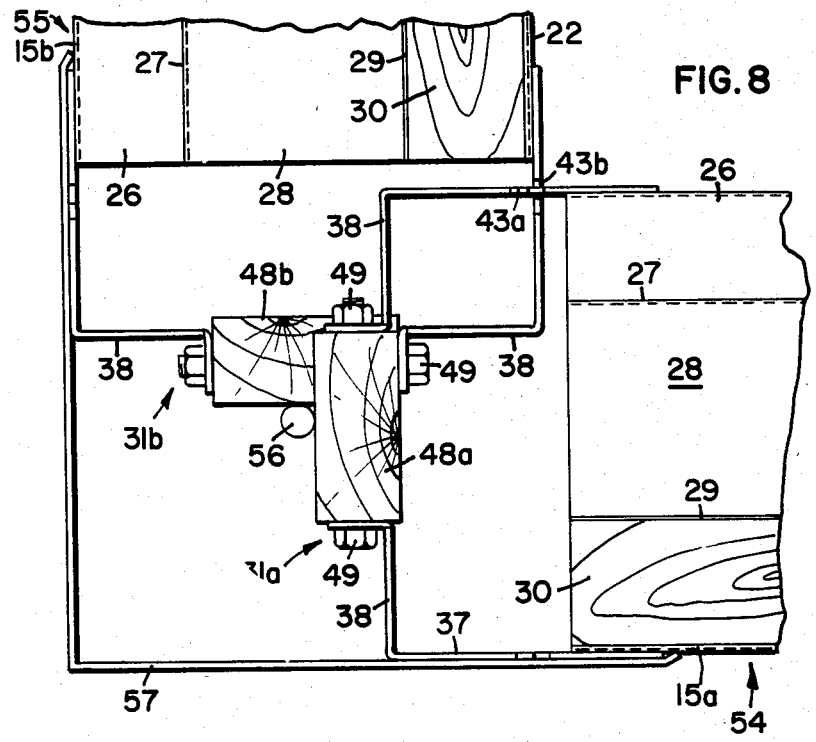
FIG. 8 is an enlarged, detailed cross-sectional view of a corner portion of the building shown in FIG. 7.
Figure 9:
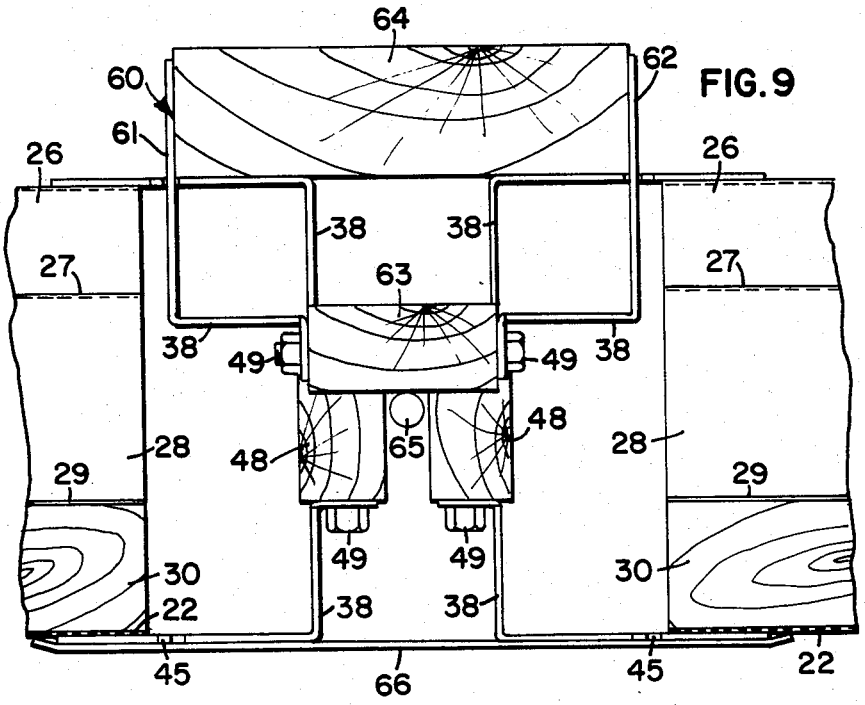
FIG. 9 is an enlarged, detailed cross-sectional view of a portion of a wall juncture shown in FIG. 7.

To appreciate these features of the building 50, FIGS. 8 and 9 show in enlarged detail the manner in which the rows of panel assemblies are interlocked with respect to each other. In FIG. 8, a portion of one corner 53 of the building 50 is shown. A panel assembly **15*a* of one side wall 54 of the building 50 is positioned at right angles to the immediately overlying panel assembly 15*b* of the building side wall 55 perpendicular thereto. The upper panel assembly 15*a* is superimposed on the lower panel assembly 15*b* and the two assemblies are interlocked in the following manner. The upper slot 43*b* on the interior side of a connector member 31*b* of the lower panel assembly 15*b* is fitted together in the lower slot 43*a* on the interior side of a connector member 31*a* of the panel assembly 15*a* immediately above and at right angles thereto. The interlocking of the slotted members 31*a*, 31*b* secures the two assemblies together. This process is then repeated for subsequent assemblies positioned above the upper panel assembly 15*a* to the height desired for the building. A steel rod 56 the height of the building is anchored in the building foundation and positioned to extend upwardly in an area of the interlocked panel assemblies immediately adjacent the connector spacers 48*a*, 48*b*. See FIG. 8. An anchor is provided to give additional protection against extreme winds which might otherwise cause an uplifting of the building. When the building has been constructed to the desirable height, the corners are finished by securing a metal flashing 57** over the exposed interlocking corners of the building. This is a conventional practice, known by those in the art, which provides an aesthetically pleasing finish without jeopardizing the structural integrity of the building.

In FIG. 9, a vertical load-bearing juncture 52 created by two adjacent vertical segments of panel assemblies in one wall of the building is shown. Referring again to FIG. 6, the building has a width of four panel assemblies and a cumulative height of fifteen panel assemblies in the primary living area of the building. Each side of the building comprises at least one and generally more than two segments of building assemblies. Each segment includes a number of panel assemblies mounted successively on top of each other, i.e. a vertical row. Adjacent segments are fixed in their orientation with each other through the use of a modified connector which interlocks end portions of adjacent segment panel assemblies together. See FIG. 9. As adjacent segments of panel assemblies are built up next to each other a vertical wall juncture 52 is formed. Horizontally aligned panel assemblies in adjacent segments are fixed together along this juncture by means of a half connector 60 being interlocked with the respective connector members on one side of the structure. The half connector includes two slotted members 61, 62 secured together and constructed and arranged in size to interlock by insertion into a respective slotted member of each of the adjacent panel assemblies. The half connector 60 is also provided with a thermally insulating spacer 63. This process is repeated as successive rows of the building assemblies are created. To "finish" the vertical juncture 52, a one-piece vertical load-bearing member 64 is secured in the aligned outwardly extending portions 67, 68 of the half connectors to conceal the interlocked connectors. In the preferred embodiment redwood is used for the load-bearing member. Lateral loads from the panel assemblies are transferred to the load-bearing connectors and downwardly therethrough, as well as through the vertical load-bearing member to the foundation. Again, a steel anchor rod 65 is provided to protect against extreme wind loads to prevent any uplifting of the building. The steel rod 65 extends upwardly through a central portion of the interlocking ends of the adjacent panel assemblies substantially between and adjacent the thermal spacers 48, 63 of the connectors at the vertical juncture. On the opposite side of the building wall from the vertical load-bearing member, metal flashing 66 is secured to conceal the otherwise exposed area of the interlocking end portions of the vertical juncture.

Figure 4:
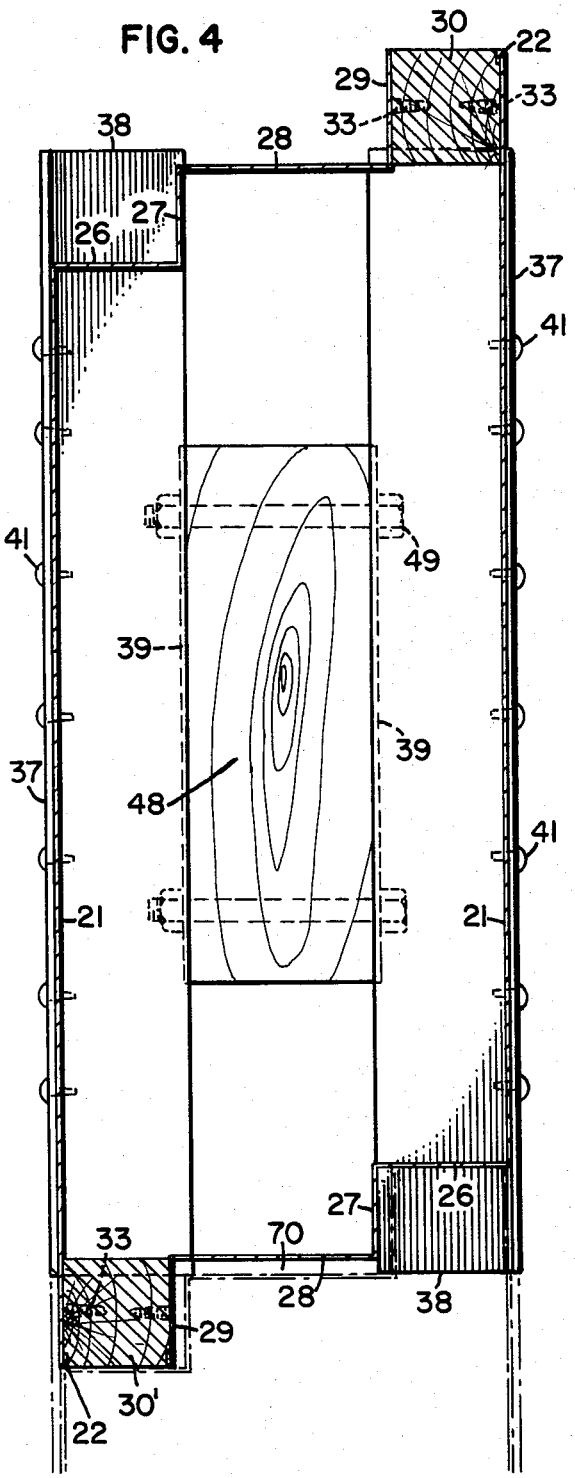
FIG. 4 is a cross-sectional view of the preferred embodiment of the present invention as seen generally along lines 4—4 in FIG. 3.

In FIG. 4, phantom lines represent the mounting of a second panel assembly 15' immediately below the panel assembly shown in the view. When one panel assembly is mounted atop another in a wall segment of assemblies the bottom of the upper assembly substantially mates along the thermal spacer portions with the top of the lower assembly. However, to insure that thermal energy is not transferred across the mating portions of the metal connecting portions, a small air space 70, i.e. a dead space, is left between the portions of the two panel assemblies which would otherwise allow thermal energy to be transferred across their surfaces if in contact. This is accomplished by the design of the panels to fit atop one another yet leave a gap between the adjacent connecting portions. Thus in forming the connencting portions of each panel the dimensions of the steps must take into account the need for the air space and thus be determined accordingly to prevent direct contact of the mating surfaces other than at the areas containing the thermal insulating spacers.

Figure 10:
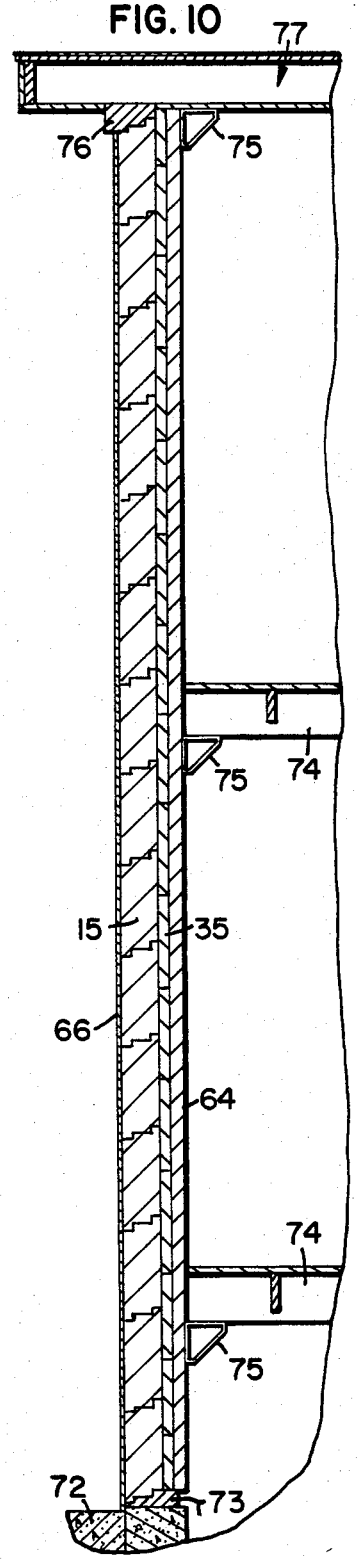
FIG. 10 is a cross-sectional view of a portion of the building as generally seen along lines 10—10 in FIG. 6.
Figure 5:
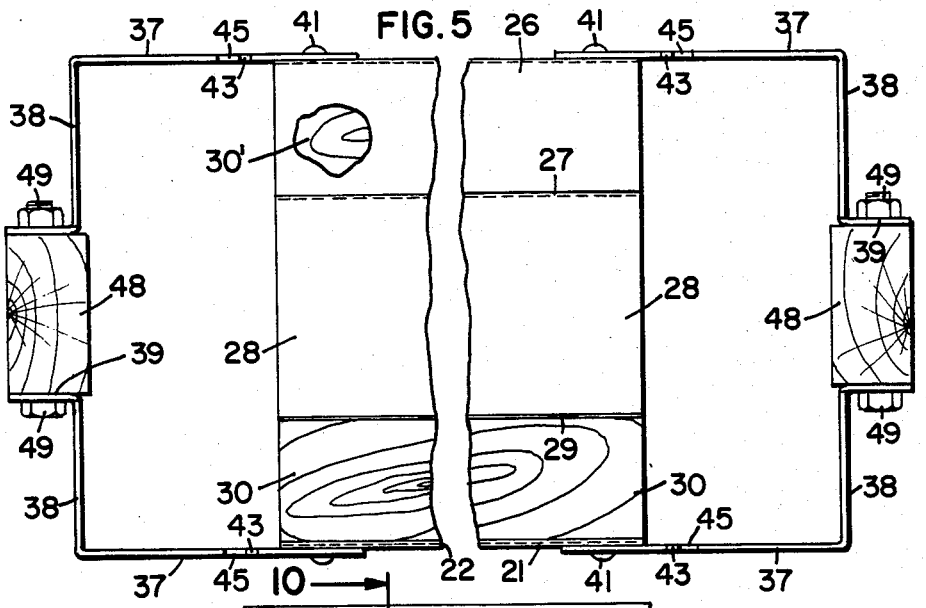
FIG. 5 is a top plan view of the preferred embodiment of the present invention.

The stacking of like panel assemblies one on top of the other to form a segment of the building wall is illustrated in FIG. 10. Fifteen panel assemblies are mounted one on top of the other and secured in this relationship as discussed above. In FIG. 10, the general construction elements of the building are shown. A concrete foundation 72 supports the overall structure 50. From a bottom sill plate 73 the panel assemblies are assembled upwardly one on top of the other. At pre-determined heights floors 74 of conventional framing are constructed and joined with the walls of the building in a conventional manner known by those skilled in the art. Beneath each floor at the vertical load-bearing members a support 75 is provided. Such supports 75 transfer the floor loads to the vertical load-bearing members 64. Like supports are also provided for the roof loads. A top sill plate 76 and conventional roof 77 complete the structure.

It should be noted that where the interlocking of panel assemblies at right angles to each other is provided, half panel assemblies are used to start and finish one side of the corner with the other side of the corner starting with and finishing with whole panel assemblies. This is necessary in order to achieve a final uniform height in the structure and necessary when using the split end connectors of the present invention. The construction of the half panel assembly is identical to that for the whole panel assembly as described above; however, it would consist of only the top one-half or the bottom one-half of the whole panel assembly.

It is believed a building constructed in accordance with the teachings of the present invention will provide a structure which is completely self-insulating yet economical to manufacture, light weight, aesthetically pleasing to the ultimate purchaser and one which is easily constructed by unskilled people. Each building assembly, and in fact each panel and each connector, is a load-bearing member which provides structural integrity to the thermally insulated assembly even though the assembly is relatively light weight. Minimum labor is demanded in the construction of a building using the panels of the present invention, with the end result being a construction providing a combination of advantages otherwise not available in any prior art building component of this kind.

What is claimed is:

1. A load-bearing building panel adapted to be secured to a like panel to create a building panel assembly having thermal insulating properties, said panel comprising:

a single-piece construction including a primary face portion having a first free end and a second end, and a connecting portion extending outwardly from said face portion second end, said connecting portion having a first end formed integral with said face portion and a second free end lying in a plane substantially parallel to said face portion, said panel being secured to a second panel of identical construction to form a thermally insulated building panel assembly in the following manner, each of said respective face portion first free ends being secured to said other panel respective connecting portion second end with thermal insulating spacers being positioned between said secured panel portions; and means on at least one of said secured panel portions for interlocking said panel assembly to a second panel assembly of like construction, said interlocking means including a connector having two slotted members and means for thermally insulating said connector members from each other.

2. A load-bearing, building panel assembly constructed to prevent conductivity of thermal energy therethrough, said panel assembly comprising:

first and second panels of like construction secured together in a manner forming a void space therebetween;

each of said panels including a primary face portion having a first free end and a second end, and a connecting portion extending outwardly from said face portion second end, said connecting portion having a first end formed integral with said face portion and a second free end lying in a plane substantially normal to said face portion;

said first panel face portion first end being secured to said second panel connecting portion free end, and said first panel connecting portion second end being secured to said second panel face portion first end;

means, for thermally insulating said secured panel portions from each other, said means being inserted between said first panel face portion first end and said second panel connecting portion free end and between said first panel connecting portion second end and said second panel face portion first end; and means for interlocking said panel assembly to a panel assembly of like construction, said interlocking means including at least one connector having a first slotted member and a second slotted member of identical construction positioned opposite said first slotted member, each of said members having a first flange and a second flange, said first member first flange being secured to one of said respective assembly panel face portions and said second member first flange being secured to said other respective assembly panel face portion, said member second flanges being secured together, said interlocking means further including a thermal insulating spacer inserted between said secured member second flanges.

3. A load-bearing building panel assembly adapted to be interlocked with a panel assembly of like construction to define a portion of a structure having thermal insulating properties, said building panel assembly having a top, a bottom, and a pair of opposing ends, said assembly panel comprising:

a pair of identically-constructed panels, each panel being constructed from a single piece of material and including a primary face portion and a connecting portion extending substantially normal thereto, said face portion of a first panel of said panel pair being secured to said connecting portion of a second panel of said panel pair, and said face portion of said second panel being secured to said connecting portion of said first panel, said panels when secured together forming a thermal insulating void space therebetween;

means for preventing conductivity of thermal energy across said panel portions secured together, said means including thermal insulating spacers inserted between said respective secured panel portions in a manner preventing any direct contact of said panels with each other; and means for interlocking said respective secured panel portions to respective secured panel portions of a panel assembly of like construction, whereby a structure having thermal insulating properties may be constructed from a plurality of said interlocking, load-bearing panel assemblies, said interlocking means including a split connector fixed at a respective end of said assembly, said connector including a first slotted member and a second slotted member of identical construction, said first slotted member being fixed to one of said panels in said assembly with said second slotted member being fixed to said other panel in said assembly at a location directly opposite and aligned with said first slotted member, said members each having a portion constructed and arranged for securement to a like portion on said other member of said respective connector to fix said connector members together, said interlocking means further including means for thermally insulating said first member from said second member including a thermal insulation spacer inserted between said connector member portions secured together.

4. The panel assembly of claim 3 wherein said panel assembly top includes one of said panel pair connecting portions and said panel assembly bottom includes said other panel pair connecting portion, each of said panel connecting portions being constructed and arranged to fit in mating relationship with a like panel connecting portion positioned immediately above said panel assembly, further, said respective connecting portions being constructed to fit together in a manner which prevents the conductivity of thermal energy across said adjacent connecting portions.

* * * * *